US005527487A

United States Patent [19]

Mikkelsen et al.

[11] Patent Number: 5,527,487

[45] Date of Patent: Jun. 18, 1996

[54] ENZYMATIC DETERGENT COMPOSITION AND METHOD FOR ENZYME STABILIZATION

[75] Inventors: Jan M. Mikkelsen, Gentofte; Lone K. Hansen, Lyngby, both of Denmark

[73] Assignee: Novo Nordisk A/S, Bagsvaerd, Denmark

[21] Appl. No.: 170,645

[22] Filed: Dec. 17, 1993

Related U.S. Application Data

[63] Continuation of Ser. No. 800,816, Nov. 27, 1991, abandoned.

[51] Int. Cl.[6] ..... C11D 3/386

[52] U.S. Cl. ..... 252/174.12; 252/DIG. 12

[58] Field of Search ..... 435/188; 252/174.12, 252/DIG. 12

[56] References Cited

U.S. PATENT DOCUMENTS

| | | | |
|---|---|---|---|
| 4,529,525 | 7/1985 | Dormel | 252/132 |
| 4,566,985 | 1/1986 | Bruno et al. | 252/174 |
| 4,668,630 | 5/1987 | Louderback | 435/184 |
| 4,842,758 | 6/1989 | Crutzen | 252/8.7 |
| 4,842,767 | 6/1989 | Warschewski | 252/525 |
| 4,933,287 | 6/1990 | Farin et al. | 435/198 |
| 4,959,179 | 9/1990 | Aronson | 252/135 |
| 5,039,446 | 8/1991 | Estell | 252/174.12 |
| 5,073,292 | 12/1991 | Hessell | 252/174.12 |
| 5,178,789 | 1/1993 | Estell | 252/174.12 |

FOREIGN PATENT DOCUMENTS

| | | |
|---|---|---|
| 0355228 | 8/1988 | European Pat. Off. . |
| 0583534 | 2/1994 | European Pat. Off. . |
| 2807090 | 8/1979 | Germany . |
| 3017690 | 7/1986 | Japan . |
| 62-269689 | 11/1987 | Japan . |
| 3004791 | 1/1991 | Japan . |
| 889689 | 12/1981 | U.S.S.R. . |
| 9300418 | 1/1993 | WIPO . |
| 9317086 | 9/1993 | WIPO . |
| 9320175 | 10/1993 | WIPO . |

OTHER PUBLICATIONS

Hiromi et al "Protein Protease Inhibitor,—The Case of Streptomyces Subtilisin Inhibitor" Biomedical Division, 1985.

Patent Abstracts of Japan, vol. 12, No. 155, C494, abstract of JP 62–269689, publ. Nov. 24, 1987 (Showa Denko K.K.).

*Primary Examiner*—Paul Lieberman
*Assistant Examiner*—Kery A. Fries
*Attorney, Agent, or Firm*—Steve T. Zelson; Cheryl H. Agris

[57] ABSTRACT

The invention relates to a detergent composition comprising a protease and one or more other enzymes, as well as comprising a reversible protease inhibitor of the peptide or protein type.

15 Claims, 5 Drawing Sheets

ENZYMATIC DETERGENT COMPOSITION AND METHOD FOR ENZYME STABILIZATION

This application is a continuation application of application Ser. No. 07/800,816, filed Nov. 27, 1991, now abandoned.

TECHNICAL FIELD

The present invention relates to a detergent composition comprising a protease and a second enzyme (which may be another protease or a non-proteolytic enzyme), to a method for stabilizing an enzyme in the presence of a protease and to an enzymatic detergent additive comprising a protease and a second enzyme.

BACKGROUND ART

Proteases are widely used as ingredients in commercial detergents, including liquids. Two different proteases may be used together (U.S. Pat. No. 4,511,490, WO 88/03946). Other enzyme types (i.e. non-proteolytic) may also be used in detergents, e.g. amylass, cellulase, lipass or peroxidase.

A major problem in formulating enzymatic detergents, especially liquid detergents, is that of ensuring enzyme stability during storage. For a detergent containing a protease together with another enzyme, the stability problem is aggravated as the protease is liable to digest and deactivate the other enzyme (i.e. the other protease or the non-proteolytic enzyme).

WO 89/04361 discloses a detergent containing a protease and a lipass, where improved lipass stability is achieved by selecting a specified groups of lipases and a specified group of proteases.

STATEMENT OF THE INVENTION

We have found that, surprisingly, the stability of an enzyme in a detergent containing a protease can be improved by incorporation of a reversible protease inhibitor of the peptide or protein type.

Accordingly, the invention provides a detergent composition comprising a protease and one or more other enzymes, characterized by further comprising a reversible protease inhibitor of the peptide or protein type. In another aspect, the invention provides a method for stabilizing an enzyme in the presence of a protease, characterized by incorporating a protease inhibitor. A further aspect of the invention provides an enzymatic detergent additive comprising a protease and one or more other enzymes in the form of a stabilized liquid or a non-dusting granulate, characterized by further comprising a reversible protease inhibitor of the peptide- or protein-type.

JP-A 62-269689 discloses improvement of the stability of a protease in a liquid detergent by incorporation of a protease inhibitor, but no other enzymes were present.

DETAILED DESCRIPTION OF THE INVENTION

Protease

The protease used in the invention is preferably of microbial origin. It may be a serine protease, preferably an alkaline microbial protease or a trypsin-like protease. Examples of alkaline proteases are subtilisins, especially those derived from Bacillus, e.g. subtilisin Novo, subtilisin Carlsberg, subtilisin 309, subtilisin 147 and subtilisin 168 (both described in WO 89/06279) and mutant subtilisins such as those described in WO 89/06279. Examples of commercial Bacillus subtilisins are Alcalase®, Savinass® and Esperase®, products of Novo Nordisk A/S. Examples of trypsin-like proteases are trypsin (e.g. of porcine or bovine origin) and the Fusarium protease described in WO 89/06270.

The amount of protease in the detergent will typically be 0.2–40 μM, especially 1–20 μM (generally 5–1000 mg/l, especially 20–500 mg/l).

Other enzymes

The other enzyme(s) used in the invention may be another protease (e.g. of the type described above) or a non-proteolytic enzyme, e.g. an amylass, a cellulase, a lipass or an oxidoreductase, such as a peroxidase. The non-proteolytic enzyme is preferably of microbial origin, e.g. derived from a strain of Bacillus, Humicola, Pseudomonas, Coprinus or Fusarium.

The amount of the other enzyme(s) in the detergent will typically be 0.2–40 μM, especially 1–20 μM (generally 5–1000 mg/l, especially 20–500 mg/l).

Inhibitor

The inhibitor used in the invention may be any inhibitor of the peptide or protein type that reversibly inhibits the protease in question, e.g. those described in Lakowski, Jr. & Kato, Ann. Rev. Biochem. (1980) 49:593–626 and S. Murao et al., in Protein Protease Inhibitor—The Case of Streptomyces subtilisin Inhibitor (1985) at pp. 1–14. Examples are trypsin inhibitors of Family IV (described in the cited references) and subtilisin inhibitors of family III, VI and VII. More particular examples are Streptomyces subtilisin inhibitor (SSI); plasminostreptin from *Streptomyces antifibrinolyticus;* barley subtilisin inhibitor CI-1 (e.g. described in Williamson et al., *Plant Mol. Biol.* 10, 1988, pp. 521–535) and CI-2 (e.g. described in Williamson et al., *Eur. J. Biochem.* 165, 1987, pp. 99–106); potato subtilisin inhibitor I (e.g. described in Cleveland et al., *Plant Mol. Biol.* 8, 1988, pp. 199–207); tomato subtilisin inhibitor (e.g. described in Graham et al., *J. Biol. Chem.* 260, 1985, pp. 6555–6560); eglin C from leech (e.g. described in Seemüller et al., *Hoppe-Seylers Z. Physiol. Chem.* 361, 1980, pp. 1841–1846); *Vicia faba* subtilisin inhibitor (e.g. described in Svendsen et al., *Carlsberg Res. Commun.* 49, 1984, pp. 493–502); and leupeptin inhibitor (e.g. described in S. Kondo et al., *J. Antibiot.* 22, 1969, pp. 558–568).

Furthermore, the inhibitor may be a modified subtilisin inhibitor of Family VI with a weaker binding affinity for the protease. Such a modified inhibitor may have one or more of the following amino acid substitutions at the indicated positions (numbered from the reactive site of the inhibitor, P1, P2 etc. are in the direction of the N-terminal and P'1, P'2 etc. are in the direction of the C-terminal of the inhibitor molecule):

P4: Val, Pro, Trp, Ser, Glu or Arg

P3: Tyr, Glu, Ala, Arg, Pro, Ser, Lys or Trp

P2: Ser, Lys, Arg, Pro, Glu, Val, Tyr, Trp or Ala

P1: Arg, Tyr, Pro, Trp, Glu, Val, Ser, Lys or Ala

P'1: Gln, Ser, Thr, Ile or Pro,

P'2: Val, Glu, Arg, Pro or Trp,

P'3: Glu, Gln, Asn, Val, Phe or Tyr.

A preferred modified inhibitor is CI-2 substituted with Arg, Pro or Glu at position P3, Lys or Arg at P2, and/or Glu, Arg or Pro at P1.

Modified inhibitors may be produced by known recombinant DNA techniques. Briefly, a DNA sequence (cDNA or a synthetic gene) encoding a known inhibitor is subjected to mutagenesis in order to replace the codon(s) for the amino acid(s) to be substituted with a new codon (codons) for the desired amino acid substitution(s). This may preferably be carried out by oligonucleotide-directed site-specific mutagenesis in bacteriophage M13 vectors (e.g. M. J. Zoller and M. Smith, Meth. Enzymol. 100 (1983) 468–500), in double-stranded DNA vectors (e.g. Y. Morinaga et al., Biotechnology (July 1984) 636–639), or by the polymerase chain reaction (PCR) (e.g. R. Higuchi, Nucl. Acids. Res. 16 (1988) 7351–7367).

The mutant gene is subsequently expressed in a suitable host strain. Suitable hosts are bacteria (e.g. strains of *Escherichia coli* or Bacillus), fungi (e.g. strains of *Saccharomyces cerevisiae* or filamentous fungi like Aspergillus), plants such as tomato or potato or established human or animal cell lines. To accomplish expression, the mutant gene has to be inserted in an expression plasmid with promoter and terminator DNA elements for the formation of translatable mutant inhibitor mRNA in vivo. The plasmid is introduced into the host by genetic transformation. The choice of expression plasmid is dependent on the type of host strain used. The expression of the mutant inhibitor may be done intracellularly or extracellularly. In the latter case, the DNA sequence coding for the mutant inhibitor is fused in frame to a DNA sequence encoding a suitable peptide signalling secretion. The secretion signal should preferably be cleaved off in vivo, resulting in secretion of the mature mutant inhibitor into the growth medium.

The amount of inhibitor preferably corresponds to a molar ratio of inhibitor reactive site to protease active site above 0.6, more preferably above 0.8 and most preferably above 1. The ratio is generally below 10, usually below 5.

The type and amount of inhibitor is preferably chosen so as to provide at least 60% (e.g. at least 80%) inhibition in the detergent as such and below 10% inhibition when the detergent is diluted with water for use in washing, typically at a concentration of 0.3–10 g/l.

Detergent

The detergent of the invention may be in any convenient form, e.g. powder, granules or liquid. The invention is particularly applicable to the formulation of liquid detergents where enzyme stability problems are pronounced. A liquid detergent may be aqueous, typically containing 20–70% water and 0–20% organic solvent (hereinafter, percentages by weight).

The detergent comprises surfactant which may be anionic, non-ionic, cationic, amphoteric or a mixture of these types. The detergent will usually contain 5–30% anionic surfactant such as linear alkyl benzene sulphonate (LAS), alpha-olefin sulphonate (AOS), alcohol ethoxy sulphate (AES) or soap. It may also contain 3–20% anionic surfactant such as nonyl phenol ethoxylate or alcohol ethoxylate.

The pH (measured in aqueous detergent solution) will usually be neutral or alkaline, e.g. 7–10. The detergent may contain 1–40% of a detergent builder such as zeolite, phosphate, phosphonate, citrate, NTA, EDTA or DTPA, or it may be unbuilt (i.e. essentially free of a detergent builder). It may also contain other conventional detergent ingredients, e.g. fabric conditioners, foam boosters, bactericides, optical brighteners and perfumes.

Detergent additive

The protease, other enzyme(s) and inhibitor may be included in the detergent of the invention by separate addition or by adding the combined additive provided by the invention. The additive will usually contain 0.2–8 mM protease (0.5–20%) and 0.2–8 mM (0.5–20%) of the second enzyme, and have an inhibitor/protease ratio as described above.

The detergent additive may be in liquid form for incorporation in a liquid detergent. A liquid additive may contain 20–90% propylene glycol; 0 5–3% (as Ca) of a soluble calcium salt; 0–10% glycerol; minor amounts of short-chain fatty acids and carbohydrate; and water up to 100%.

BRIEF DESCRIPTION OF THE DRAWINGS

The present invention is illustrated in further detail in the following examples with reference to the appended drawings, wherein.

EXAMPLE 1

A concentrated liquid detergent was formulated as follows (% by weight of active substance):

| | |
|---|---|
| LAS (Nansa 1169/p) | 5% |
| AES (Berol 452) | 5 |
| Oleic:coco fatty acid (1:1) | 10 |
| AE (Dobanol 25-7) | 15 |
| Triethanolamine | 5 |
| NaOH | 1.1 |
| SXS | 3 |
| Ethanol | 4.8 |
| Propylene glycol | 8 |
| Glycerol | 2 |
| $CaCl_2$ | 0.045 |
| Sodium citrate | 0.089 |
| Phosphonate (Dequest 2060 S) | 0.5 |
| pH | 8.0 |

A detergent according to the invention was prepared by addition of Streptomyces subtilisin inhibitor (SSI, 0.05 mg/ml, 4.5 μM) to a detergent of the composition: 52 (v/v) % of the above concentrated detergent in water containing 10 mg/ml (300 μM) Humicola lipase (Lipolase™) and 0.1 mg/ml (3.6 μM) Savinase®.

Another detergent was prepared by addition of inhibitor CI-2 (0.03 mg/ml, 3.3 μM) to a detergent of the composition 55 (v/v) % concentrated detergent in water containing 10 mg/ml (300 μM) Humicola lipase (Lipolase™) and 0.1 mg/ml (3.6 μM) Savinase®.

Both detergents were stored for 13 days at room temperature together with reference detergents of the same composition, but without inhibitor. The lipase activity was measured at various times and expressed in % of initial lipase activity. The results, shown in the two figures, demonstrate a pronounced stabilizing effect on the lipase by addition of the protease inhibitor.

EXAMPLE 2

Figure 1:
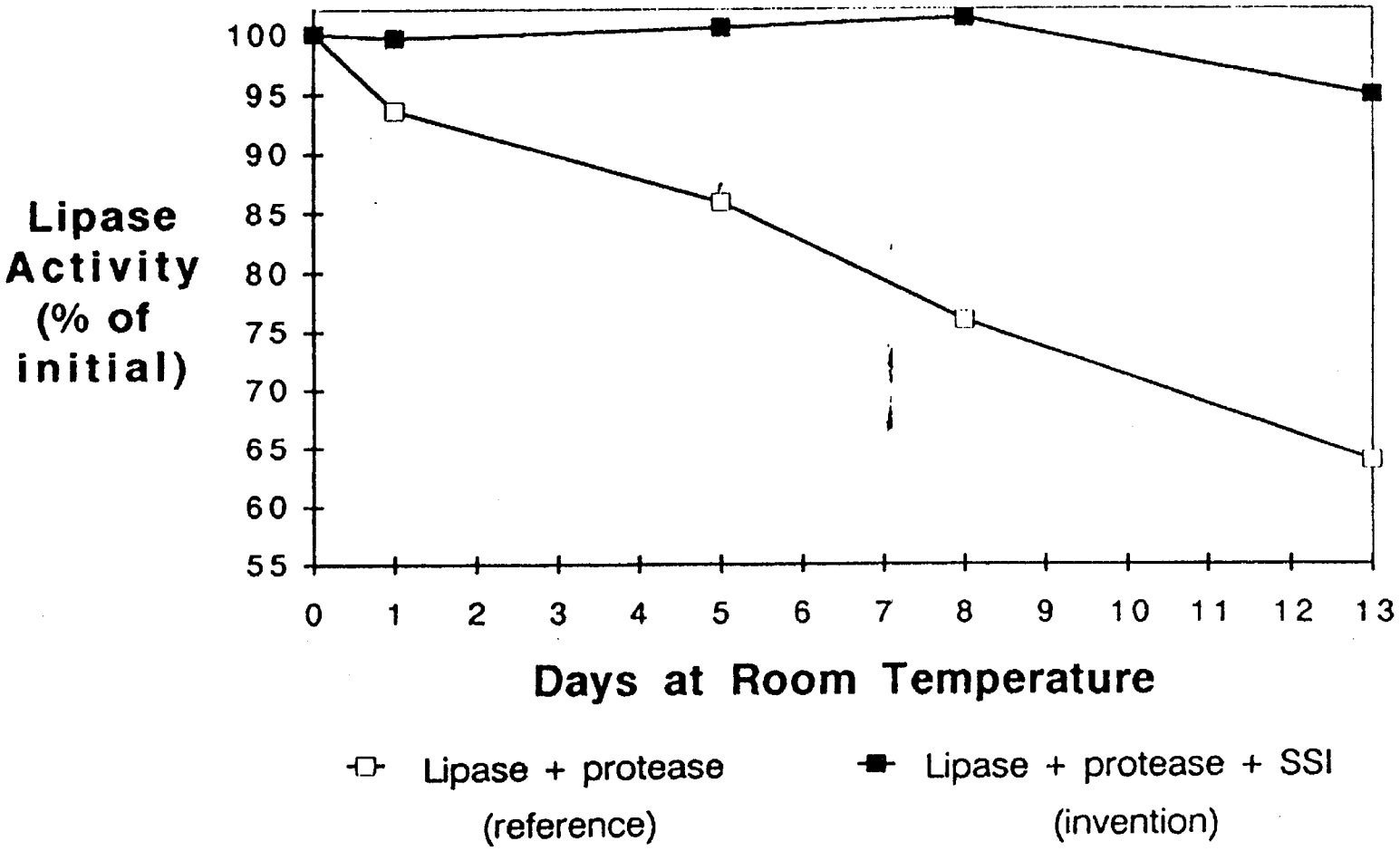
FIG. 1 is a graph showing the residual activity (in %) after 13 days at room temperature of lipase in a detergent composition containing lipase and protease alone compared to a composition containing lipase, protease and Streptomyces subtilisin inhibitor.
Figure 2:
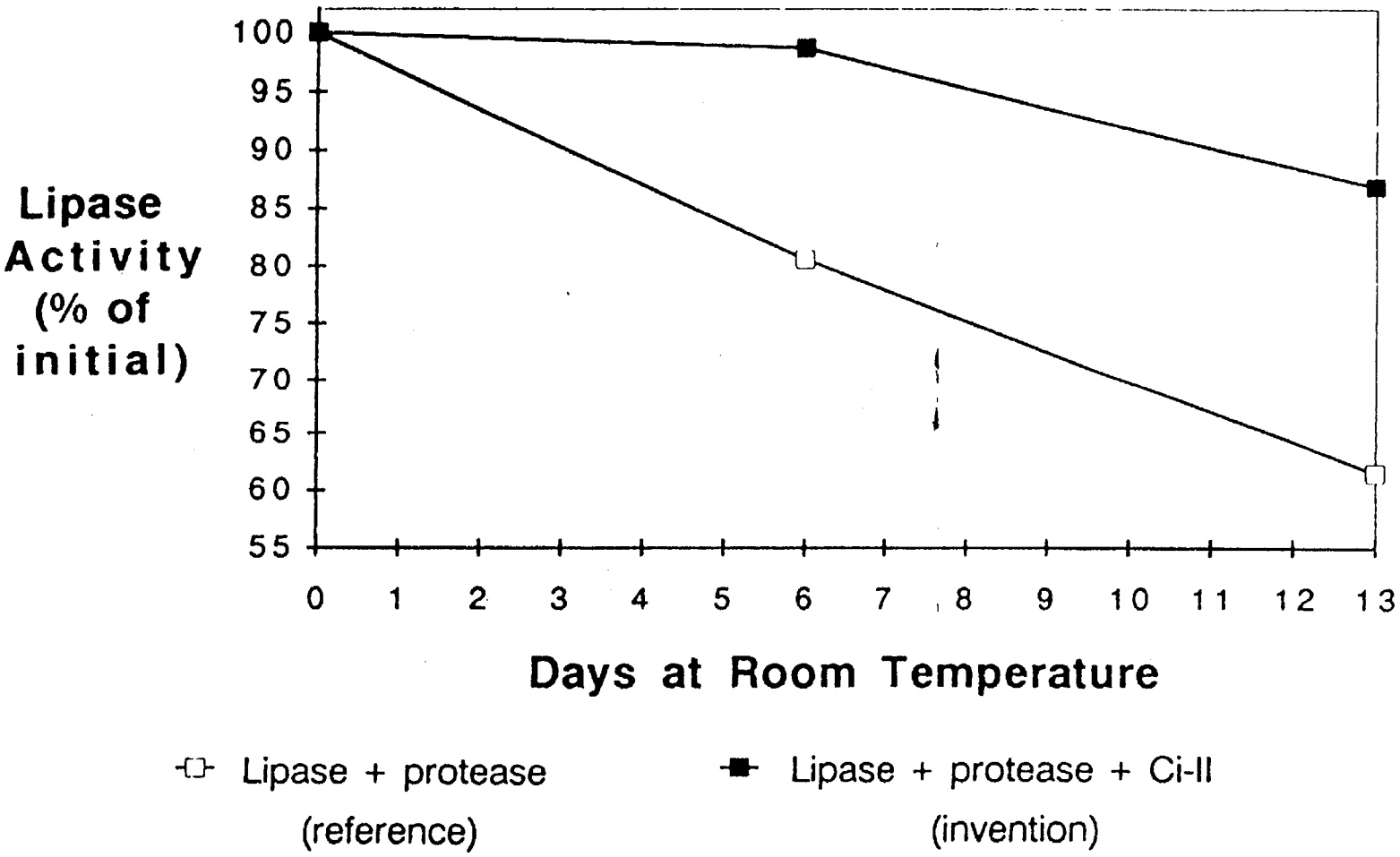
FIG. 2 is a graph showing the residual activity (in %) after 13 days at room temperature of lipase in a detergent composition containing lipase and protease alone compared to a composition containing lipase, protease and barley subtilisin inhibitor CI-2.
Figure 3:
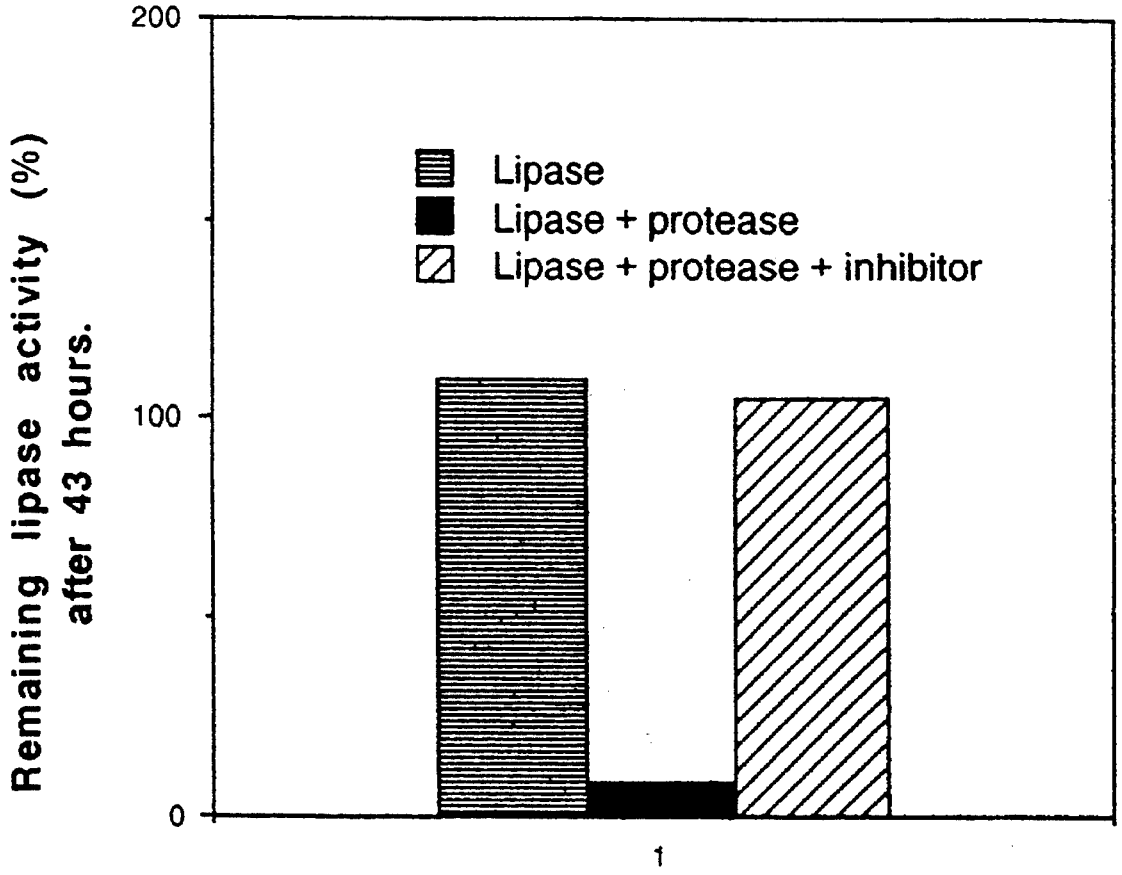
FIG. 3 is a graph showing the residual activity (in %) after 43 hours at room temperature of lipase in the presence of protease with or without added leupeptin inhibitor.

The protection of lipase from proteolytic degradation in the presence of a protease inhibitor was determined by adding 0.67 g/l leupeptin inhibitor to a mixture of 0.5 g/l *Pseudomonas cepacia* lipase and 2 g/l Fusarium protease in 50 mM Tris-HCl, pH 8.0, at 20° C. and measuring the residual lipase activity (in %) after 43 hours. From the results shown in FIG. 3 it appears that there is very little degradation of the lipase in the presence of the leupeptin inhibitor, whereas the lipase is almost completely degraded when no inhibitor is added. The protease activity may be restored by dilution. After storage for 43 hours followed by 100-fold dilution, the protease activity was 327 U/ml (U=arbitrary units established by means of the synthetic substrate N-p-tosyl-Gly-Pro-Arg-p-nitroanilide) in the preparation containing lipase and protease, and 366 U/ml in the equivalent preparation which also contains the leupeptin inhibitor.

EXAMPLE 3

A concentrated liquid detergent was formulated as follows (% by weight of active substance):

| | |
|---|---|
| LAS (Nansa 1169 P) | 10% |
| AEO (Berol 160) | 15% |
| Ethanol | 10% |
| Triethanolamine | 5% |

A detergent according to the invention was prepared by addition of Streptomyces subtilisin inhibitor (SSI, 0.09 mg/ml, 7.7 μM) to a detergent (90% (w/w) of the above concentrated detergent in water) containing 0.12 mg/ml (3.3 μM) Humicola cellulase and 0.18 mg/ml (6.7 μM) Savinase®.

Another detergent was prepared by addition of inhibitor CI-2 (0.07 mg/ml, 7.8 μM) to a detergent (90% (w/w) of the above concentrated detergent in water) containing 0.12 mg/ml (3.3 μM) Humicola cellulase and 0.18 mg/ml (6.7 μM) Savinase®.

Figure 4:
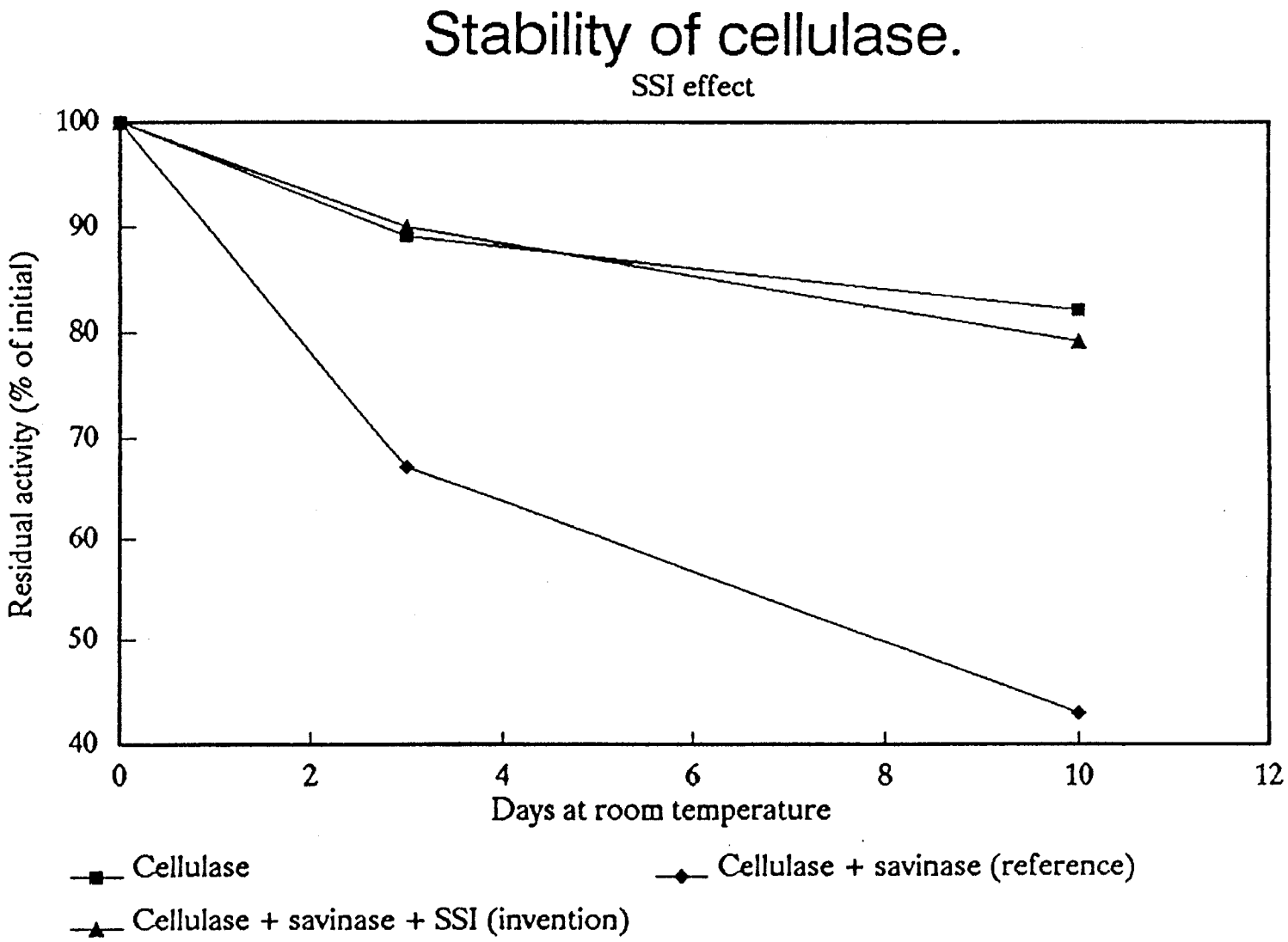
FIG. 4 is a graph showing the residual activity (in %) after 10 days at room temperature of cellulase in the presence of protease with or without added Streptomyces subtilisin inhibitor.
Figure 5:
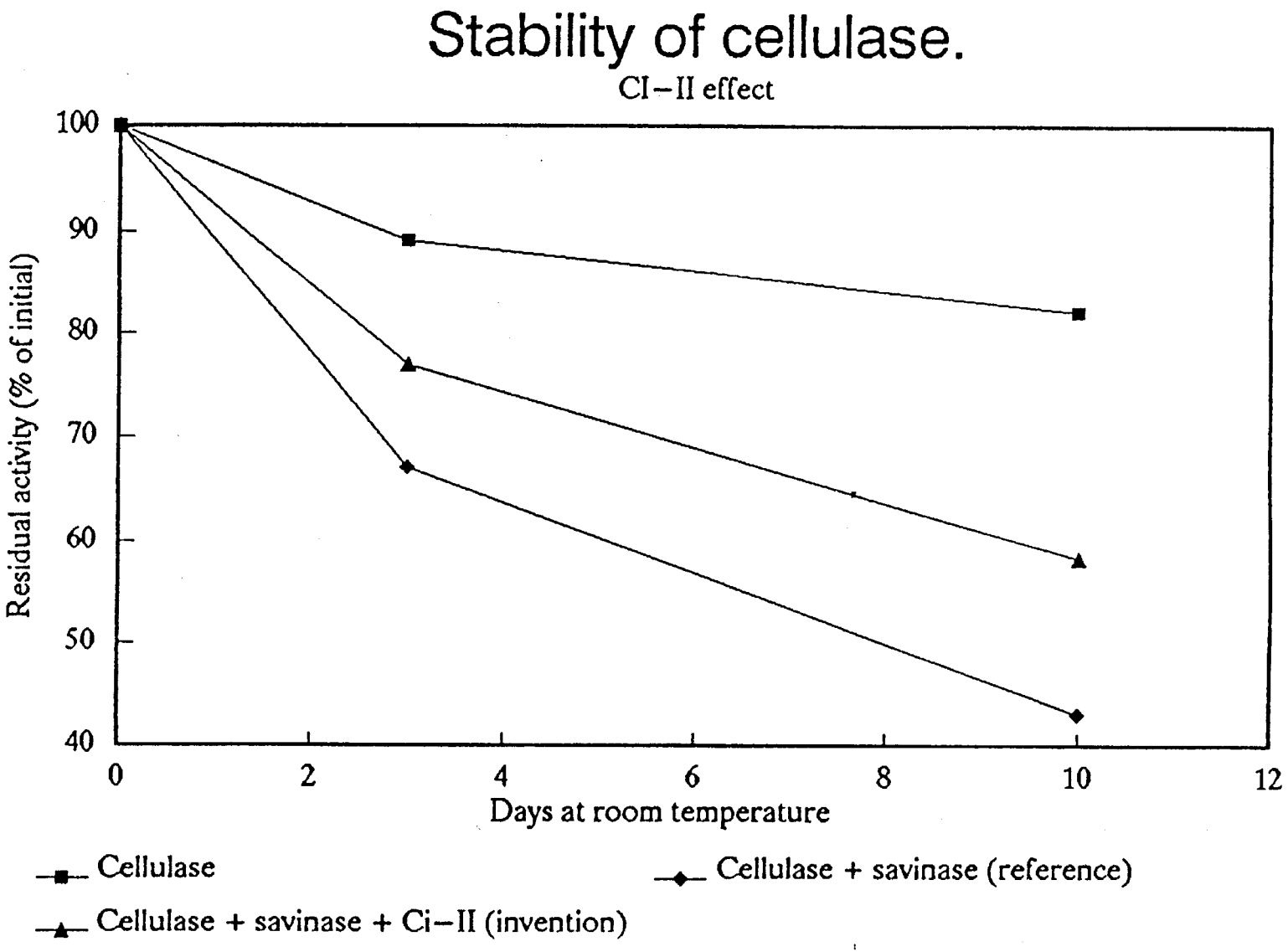
FIG. 5 is a graph showing the residual activity (in %) after 10 days at room temperature of cellulase in the presence of protease with or without added CI-2 inhibitor.

Both detergents were stored for 10 days at room temperature together with a reference detergent without any inhibitor. The residual cellulase activity was measured at various times and expressed in % of initial cellulase activity. The results, shown in FIG. 4 and 5 demonstrate a pronounced stabilizing effect on the cellulase by addition of protease inhibitor, especially with SSI.

We claim:

1. A detergent composition comprising an enzymatically effective amount of a protease, an enzymatically effective amount of a second enzyme selected from the group consisting of cellulase, lipase, amylase, and oxidoreductase, a reversible protein protease inhibitor of family VI selected from the group consisting of a barley subtilisin inhibitor, a potato subtilisin inhibitor, a tomato subtilisin inhibitor and a *Vicia faba* subtilisin inhibitor in an enzyme inhibiting amount and an amount sufficient to stabilize the second enzyme, and a surfactant.

2. The detergent composition according to claim 1, wherein the molar ratio of inhibitor reactive site to protease active site is above 0.6.

3. The detergent composition according to claim 1, wherein the amount of protease is 0.2–40 μM.

4. The detergent composition according to claim 1, wherein the protease is a serine protease.

5. The detergent composition according to claim 1, wherein the serine protease is an alkaline microbial protease.

6. The detergent composition according to claim 5, wherein the alkaline microbial protease is a subtilisin.

7. The detergent composition according to claim 6, wherein the subtilisin is selected from the group consisting of subtilisin Novo, subtilisin Carlsberg, BPN', subtilisin 309, subtilisin 147 and subtilisin 168.

8. The detergent composition according to claim 1, wherein the degree of protease inhibition in the detergent is at least 60%.

9. The detergent composition according to claim 1, wherein the degree of protease inhibition in a 1% detergent solution in water is below 10%.

10. The detergent composition according to claim 1 in which said composition is liquid.

11. The detergent composition according to claim 1, wherein the oxidoreductase is a peroxidase.

12. The detergent composition according to claim 1, wherein the second enzyme is derived from Bacillus, Humicola, Pseudomonas, Coprinus or Fusarium.

13. The detergent composition according to claim 1, wherein the protease is trypsin.

14. The detergent composition according to claim 13, wherein the protease is derived from Fusarium.

15. An enzymatic detergent additive in the form of a stabilized liquid or non-dusting granulate, comprising an enzymatically effective amount of protease and an enzymatically effective amount of a second enzyme selected from the group consisting of cellulase, lipase, amylase, and oxidoreductase, and a reversible protein protease inhibitor of family VI selected from the group consisting of a barley subtilisin inhibitor, a potato subtilisin inhibitor, a tomato subtilisin inhibitor and a *Vicia faba* subtilisin in an enzyme inhibiting amount and an amount to stabilize the second enzyme.

* * * * *